US005675959A

United States Patent [19]

Hamma et al.

[11] Patent Number: 5,675,959

[45] Date of Patent: Oct. 14, 1997

[54] OPENING FINGERS FOR ENVELOPE INSERTING APPARATUS

[75] Inventors: John C. Hamma, Milford, Conn.; Martyn R. House, Puckeridge, United Kingdom; David W. Hubbard, Stamford; John R. Nobile, Fairfield, both of Conn.

[73] Assignee: Pitney Bowes Inc., Stamford, Conn.

[21] Appl. No.: 588,498

[22] Filed: Jan. 18, 1996

[51] Int. Cl.[6] ..... B65B 43/26

[52] U.S. Cl. ..... 53/381.1; 53/381.3; 53/381.5; 53/381.7

[58] Field of Search ..... 53/381.1, 381.3, 53/381.5, 381.7; 493/212, 216

[56] References Cited

U.S. PATENT DOCUMENTS

| | | | |
|---|---|---|---|
| 2,668,053 | 2/1954 | Bach | 53/381.7 |
| 4,852,334 | 8/1989 | Auerbach | 53/381.5 |
| 4,944,137 | 7/1990 | Krasuski et al. | 53/381.7 |
| 5,255,498 | 10/1993 | Hotchkiss et al. | 53/381.5 |
| 5,414,977 | 5/1995 | Cohen | 53/381.5 |
| 5,511,357 | 4/1996 | Ricketts et al. | 53/381.5 |
| 5,517,797 | 5/1996 | Ballard et al. | 53/381.5 |

*Primary Examiner*—John Sipos
*Assistant Examiner*—Gene L. Kim
*Attorney, Agent, or Firm*—Christopher J. Capelli; Robert H. Whisker; Melvin J. Scolnick

[57] ABSTRACT

Apparatus for opening an envelope having a front panel, a back panel and a closing flap. The apparatus includes: a device for supporting the envelope in a substantially horizontal plane wherein the back panel is situated above the front panel; a device for holding the closing flap below the back panel; an opening horn for separating the back panel from the front panel, the opening horn being pivotable in a vertical plane; and a device for causing the horn to initially contact the closing flap and to pivot the horn into the envelope between the front and back panels, and to raise the horn inside the envelope, whereby the front and back panels are separated.

5 Claims, 9 Drawing Sheets

OPENING FINGERS FOR ENVELOPE INSERTING APPARATUS

BACKGROUND OF THE INVENTION

The instant invention relates to apparatus for inserting documents into envelopes, and more particularly to fingers for opening the envelope wider for the inserting of documents.

Envelope inserting apparatus is well known, and involves inserting paper documents into a waiting envelope that has had its front and rear panels spread apart to receive the insert material. In the inserting station, the envelope arrives first and is typically opened by a combination of devices which may include bending rolls and hold-down fingers. The contents to be inserted then arrive through a second path and are driven into the envelope. Typically, the last part of the inserting motion is accomplished ballistically for about 0.5" to 0.8" using the kinetic energy of the inserts. Reliability problems exist with this system because the envelope does not always open sufficiently, and, due to the bent nature of the envelope, drag is created on the insert material preventing it from reaching the bottom of the envelope.

Thus, the instant invention provides apparatus which positively opens the envelope and holds the envelope open, thereby greatly reducing the amount of drag on the insert material and assuring that the insert material is reliably inserted into the waiting envelope.

SUMMARY OF THE INVENTION

Accordingly, the instant invention provides apparatus for opening an envelope having a front panel, a back panel and a closing flap. The apparatus includes: a device for supporting the envelope in a substantially horizontal plane wherein the back panel is situated above the front panel; a device for holding the closing flap below the back panel; an opening horn for separating the back panel from the front panel, the opening horn being pivotable in a vertical plane; and a device for causing the horn to initially contact the closing flap and to pivot the horn into the envelope between the front and back panels, and to raise the horn inside the envelope, whereby the front and back panels are separated.

DETAILED DESCRIPTION OF THE PREFERRED EMBODIMENT

Figure 5:
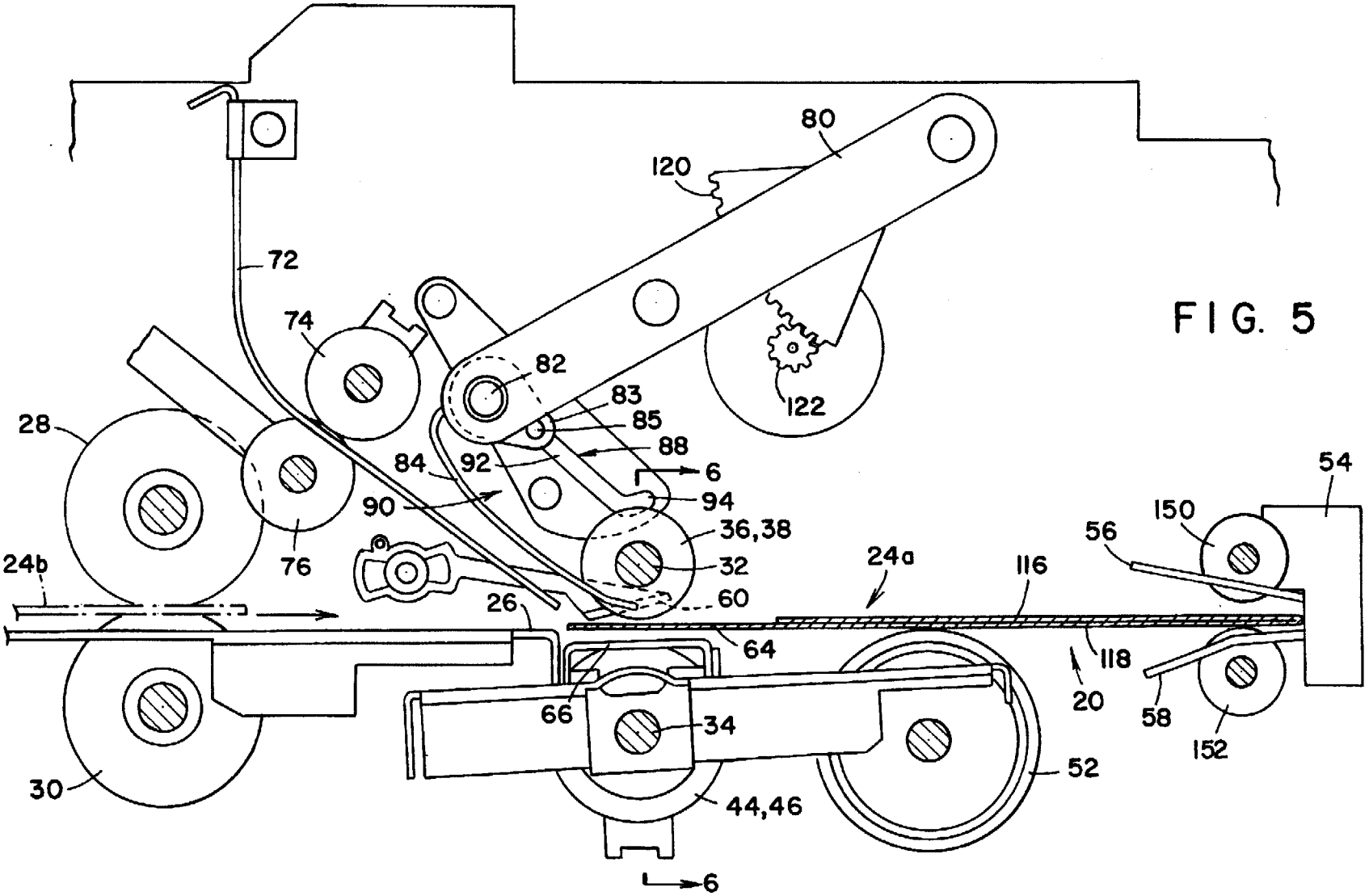
FIG. 5 is a side, elevational view of the inserting apparatus in accordance with the instant invention, showing an envelope prior to being opened for insertion.
Figure 6:
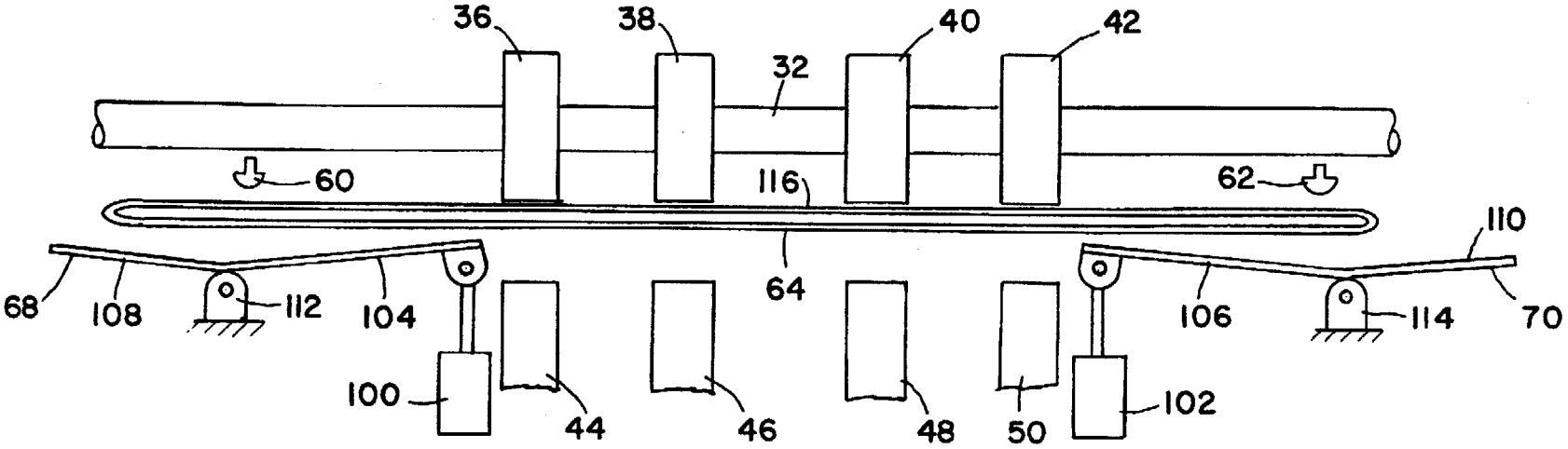
FIG. 6 is a sectional view taken on the plane indicated by the line 6—6 in FIG. 5.

In describing the preferred embodiment of the instant invention, reference is made to the drawings, wherein there is seen FIG. 5 an inserting station generally designated 20 for inserting paper documents 22 (see FIG. 10) into a waiting envelope **24*a*. The inserting station 20 includes a supporting deck 26 and a pair of envelope feed rollers 28 and 30 for feeding an envelope 24*b* to the position occupied by the envelope 24*a*. Downstream of the rollers 28 and 30 are a fixed, upper shaft 32 and a vertically translatable, lower, drive shaft 34. The upper shaft 32 supports four, spaced feed rollers 36, 38, 40 and 42 rotatably secured thereto (see FIGS. 1, 2, 3, 6 and 8) while the lower shaft 34 supports four spaced, cooperating drive rollers 44, 46 48 and 50 respectively fixedly secured to the drive shaft 34**.

Downstream of the shafts 32 and 34 is a pivotable, bending roll 52 and further downstream is vertically translatable envelope stop 54. An upper guide 56 and a lower guide 58 provide a path toward the stop 54 for the envelope **24*a***.

A pair of pivotable, hold-down fingers 60 and 62 (see FIGS. 1 and 5) are situated between the shafts 32 and 34 and function, as explained in further detail hereinbelow, to hold the envelope flap 64 against a supporting plate 66. Situated beneath the hold-down fingers 60 and 62 are a pair of flapper paddles 68 and 70 which cooperate with the fingers 60 and 62 respectively to open the envelope **24*a* as explained in further detail hereinbelow. The flapper paddles 68 and 70 each consist of an interior, angled leg 104 and 106 respectively and an exterior, angled leg 108 and 110 respectively. Each paddle 68 and 70 is pivotable about a support 112 and 114 respectively, which supports are located slightly inside the outside edges of the envelope and under the envelope flap 64**.

The paper documents 22 which are to be inserted into the waiting envelope **24*a* are fed by upstream feed apparatus (not shown), such as folding rollers, along a chute 72 toward a pair of insert feed rollers 74 and 76 which continue to feed the documents 22 through the opening between the upper rollers 36, 38, 40 and 42 and the lower rollers 44, 46, 48 and 50. The momentum given the documents 22 by the feed rollers 74 and 76 conveys the documents 22 into the waiting envelope 24*a***.

Figure 1:
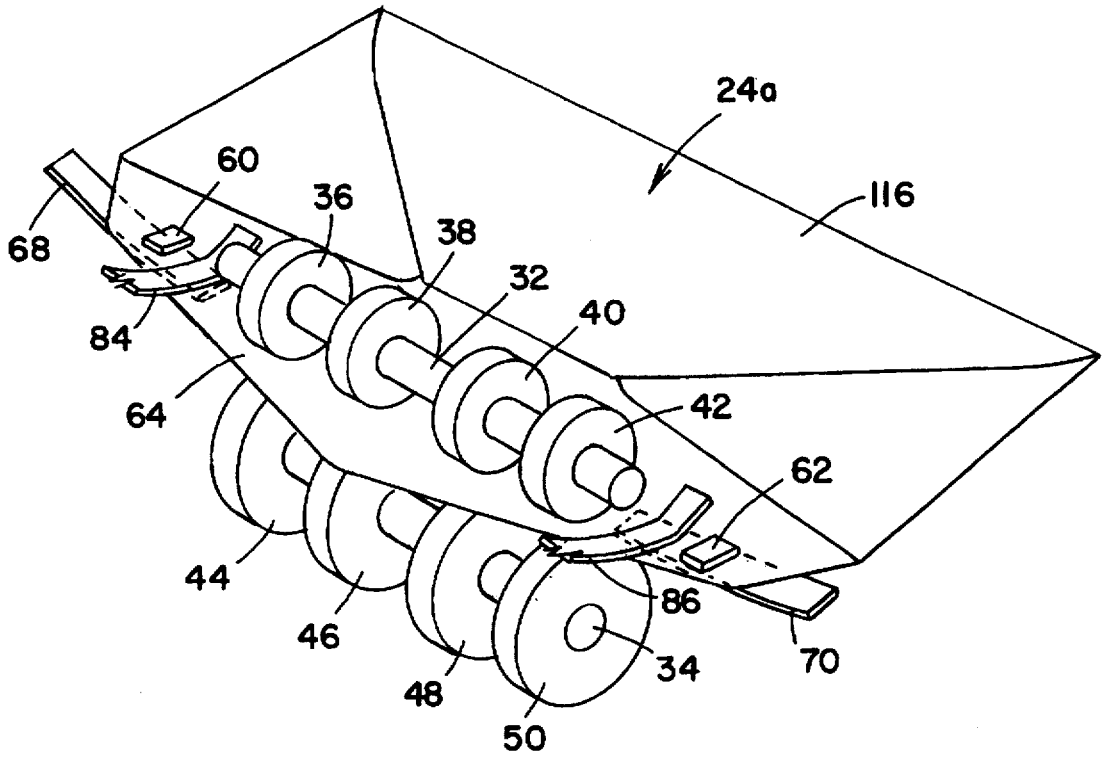
FIG. 1 is a perspective view of envelope opening apparatus in accordance with the instant invention showing the opening horns about to enter the envelope.
Figure 2:
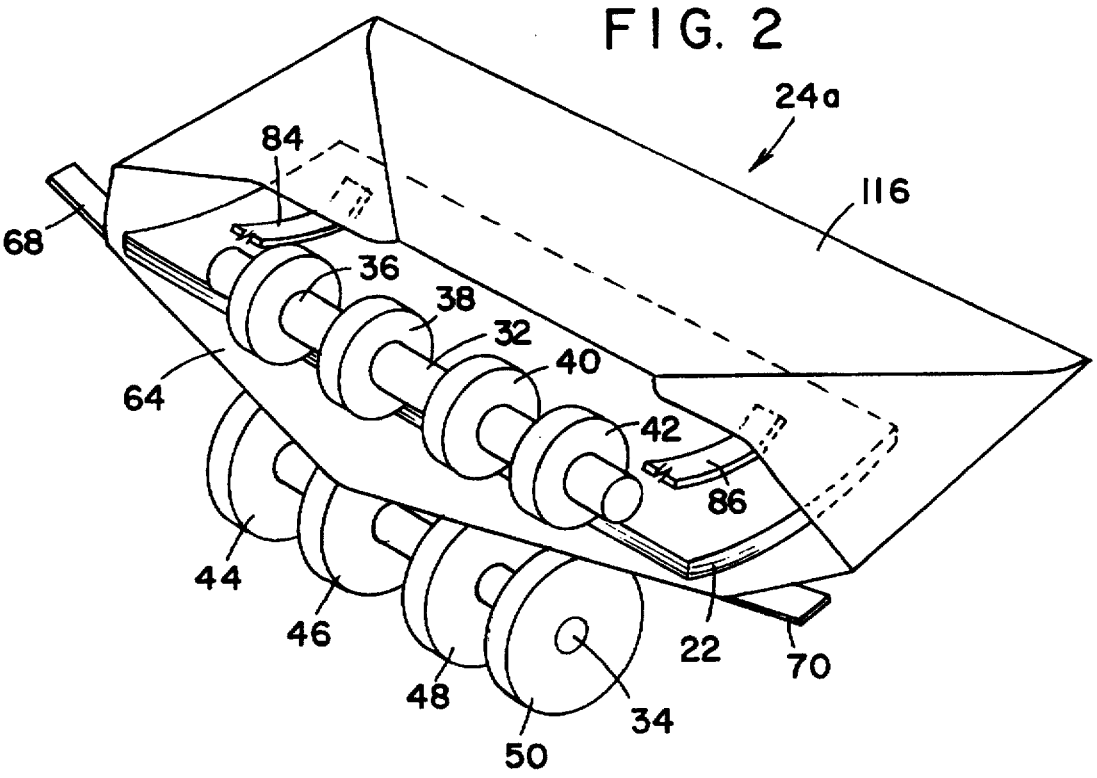
FIG. 2 is similar to FIG. 1 but shows the opening horns fully engaging the envelope and enclosure documents being inserted into the envelope.
Figure 3:
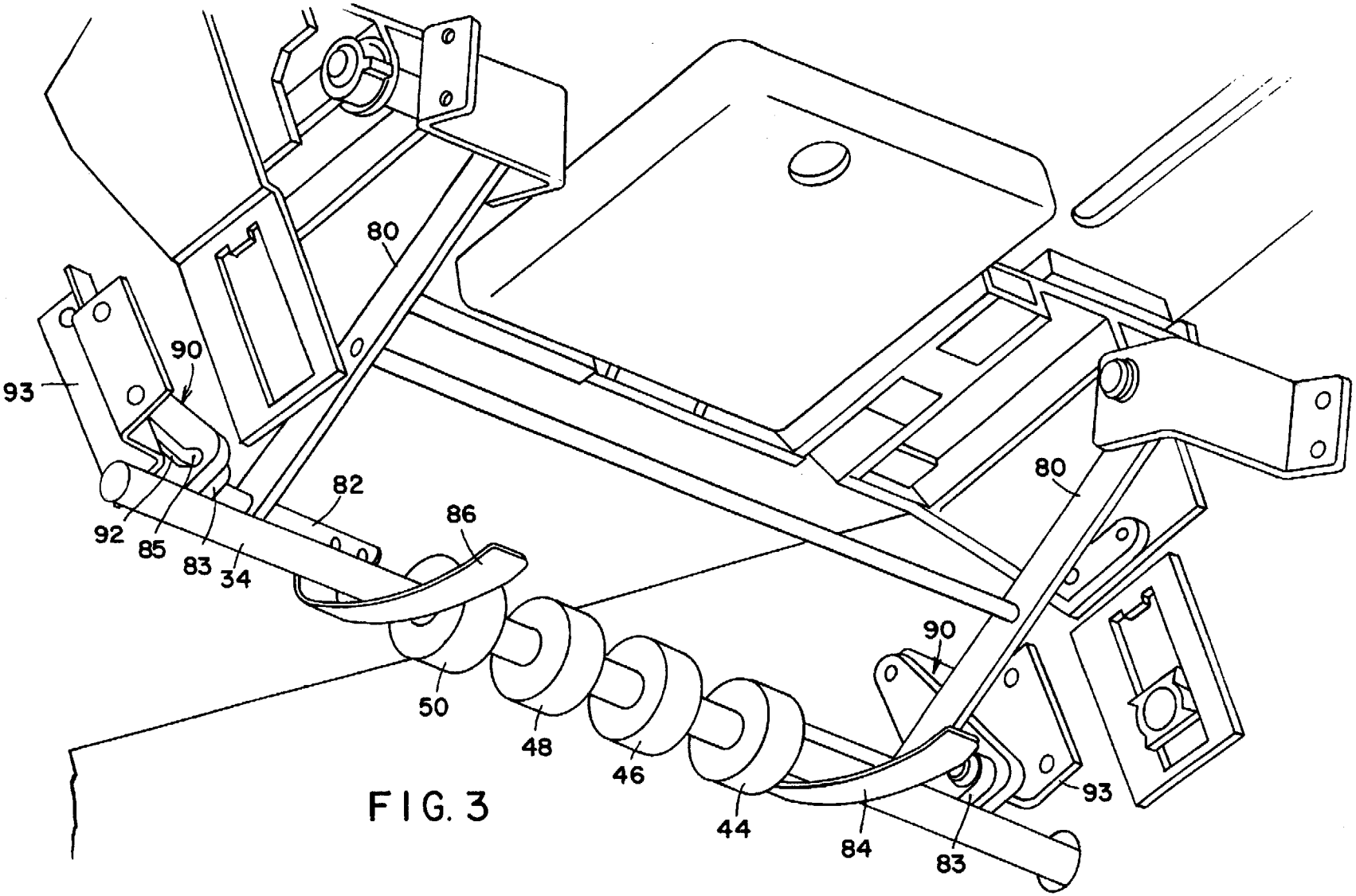
FIG. 3 is a bottom, perspective view of the opening horns and associated drive for the horns.
Figure 4:
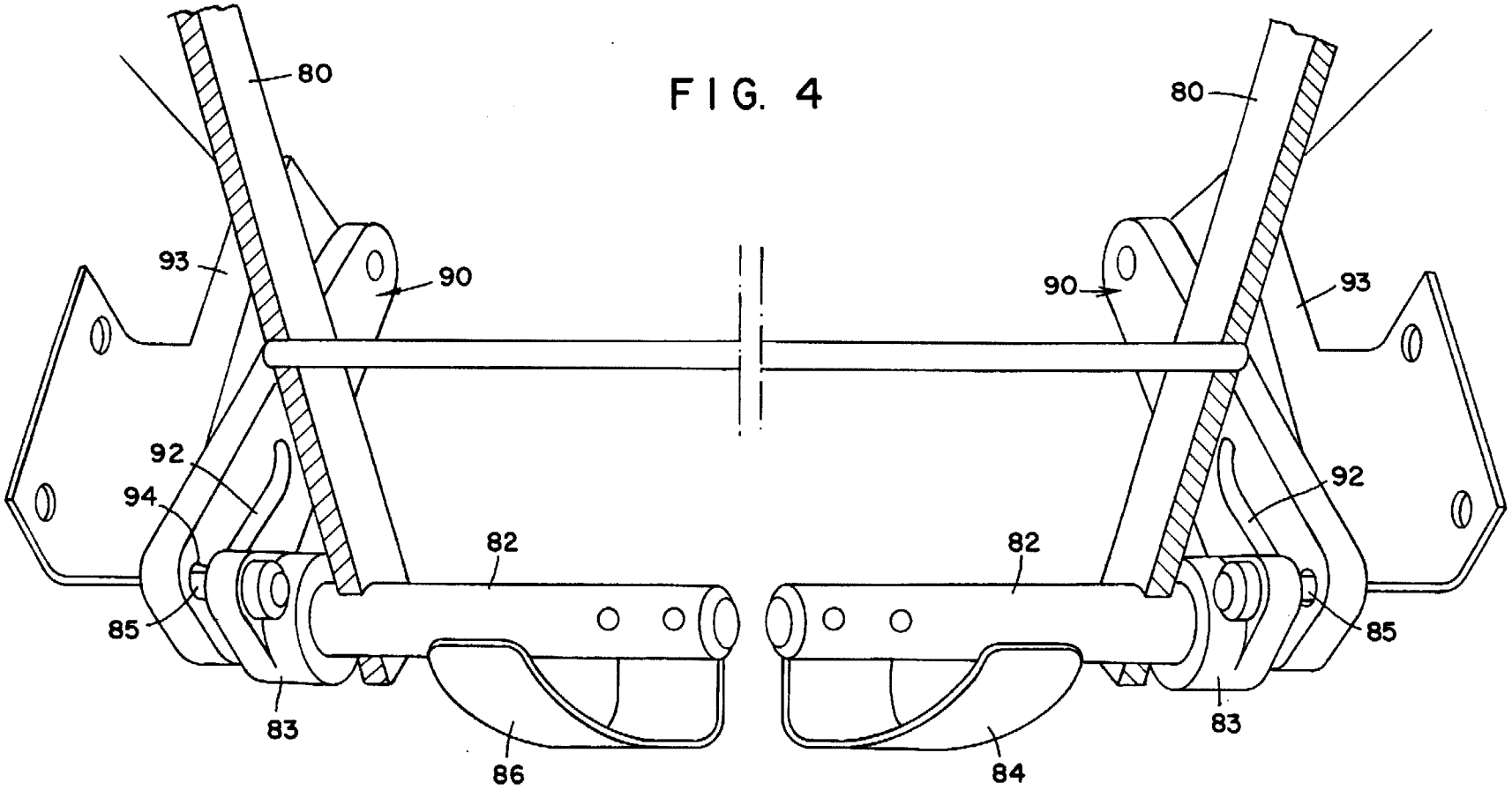
FIG. 4 is a front, perspective view of the opening horns and associated drive apparatus.

The insert station 20 further includes a pair of pivotable support arms 80 which rotatably support, at their lower ends, a rotatable shaft 82. A pair of opening horns 84 and 86 are fixedly secured to the laterally extending shaft 82. At the opposite ends of the shaft 82 are a pair of link members 83 each fixedly secured at one end to the shaft 82 and at the other end rotatably secured to a pin 85. Each of the pins 85 travels in a groove 88 of a guide member 90 fixedly secured to a bracket 93 (see FIG. 4). The major portion of the groove 88 consists of a straight slot section 92 at its upstream end, while the minor portion of the groove 88 concludes at its downstream end with an angled slot section 94 whose axis is oriented at an angle of about 50 to 70 degrees with the axis of the straight slot section 92. The purpose of the angled slot section 94 will be discussed in greater detail hereinbelow.

The operation of the insertion station 20 will now be described. The envelope feed rollers 28 and 30 cooperate to feed an envelope from the position occupied by envelope 24b to the position occupied by envelope 24a against the envelope stop 54 in the down position, as shown in FIG. 5. The feed rollers 36, 38, 40 and 42 are separated from the drive rollers 44, 46, 48 and 50 respectively so that the envelope can be conveyed directly to the stop 54. The bending roll 52 is pivoted upward in its raised position for bending of the envelope. The hold-down fingers 60 and 62 are in a raised position to allow the envelope to pass thereunder, and the flapper paddles 68 and 70 are in a position where their interior ends 96 and 98 respectively are raised to support the envelope flap 64 in a horizontal plane.

Figure 8:
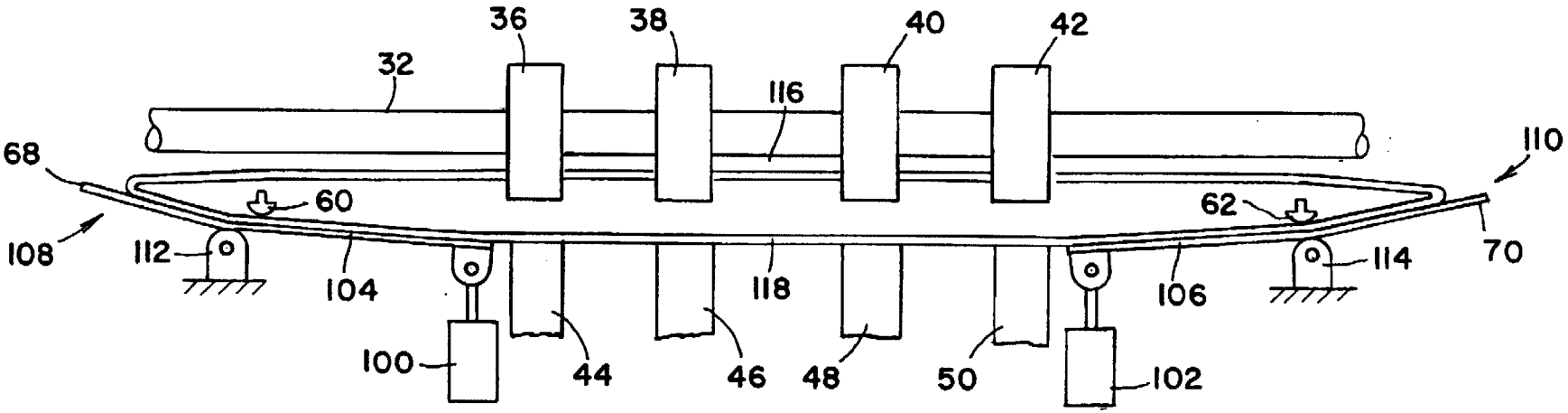
FIG. 8 is a sectional view taken on the plane indicated by the line 8—8 in FIG. 7.
Figure 7:
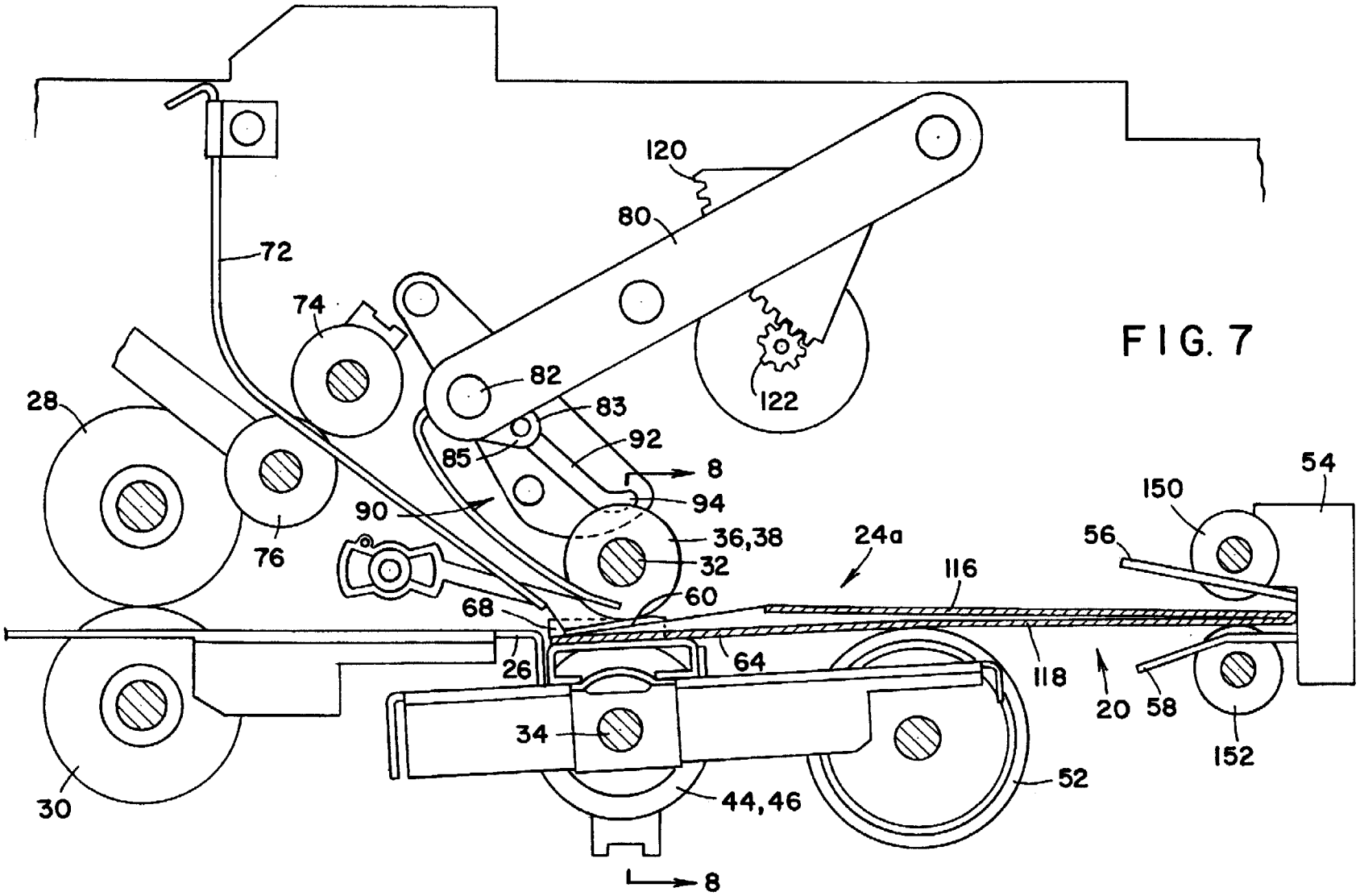
FIG. 7 is similar to FIG. 5 but shows the hold-down fingers rotated to engage the envelope flap and the back panel of the envelope slightly raised.

Once the envelope has reached the position of the envelope 24a, the flapper paddles 68 and 70 are rotated by a pair of solenoids 100 and 102 respectively to the positions seen in FIG. 8 so that the envelope 24a can be puckered, i.e. the envelope front panel 118 (address bearing panel) is separated from the back panel 116 (see FIG. 7). The hold-down fingers 60 and 62 are rotated downward to the positions seen in FIGS. 7 and 8 against the flapper paddles 68 and 70 respectively, thereby forcing the panel 64 downward and puckering the envelope 24a and causing it to open.

Figure 9:
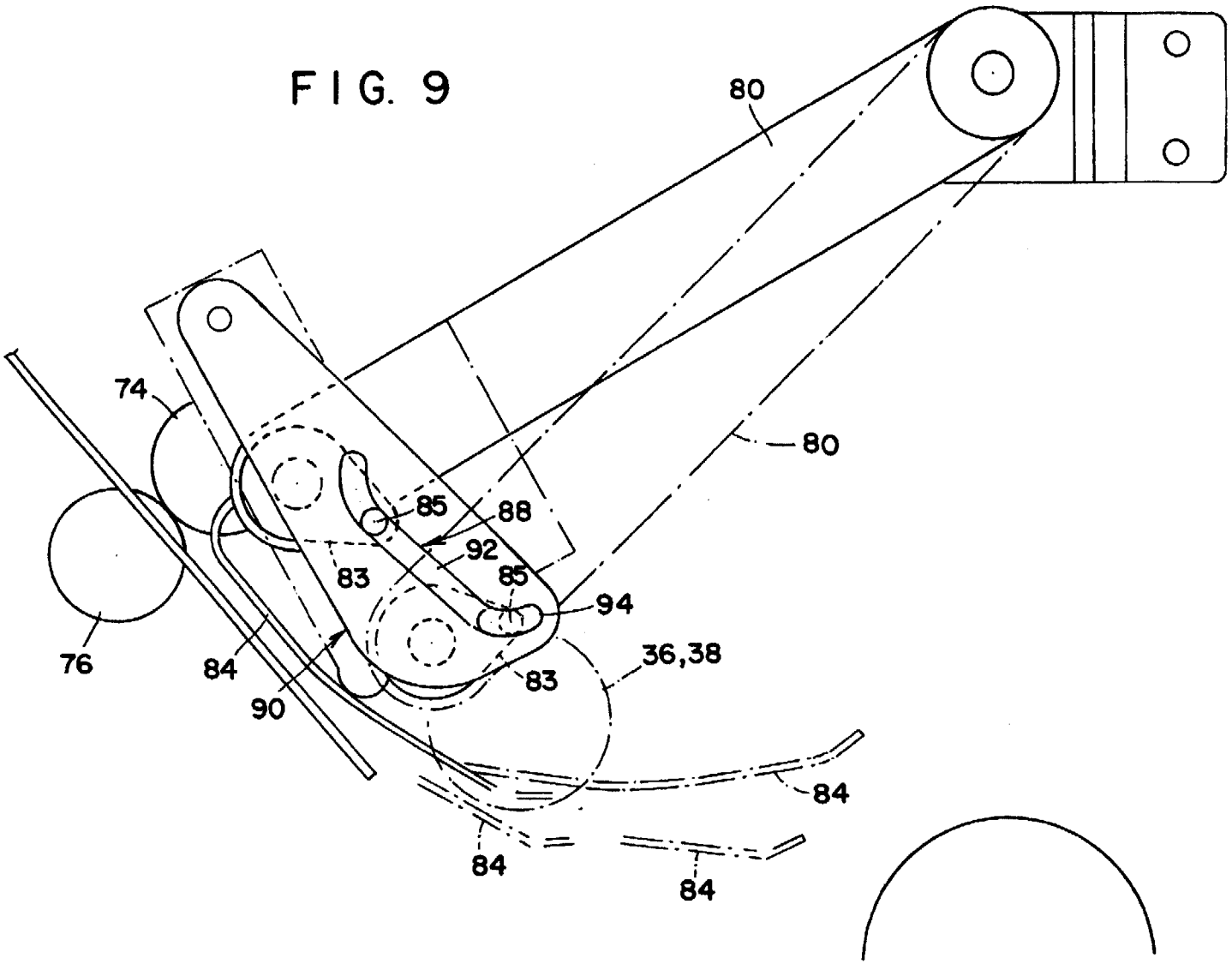
FIG. 9 is a side, elevational view of the opening horns and associated drive at the beginning and end of their cycle.
Figure 10:
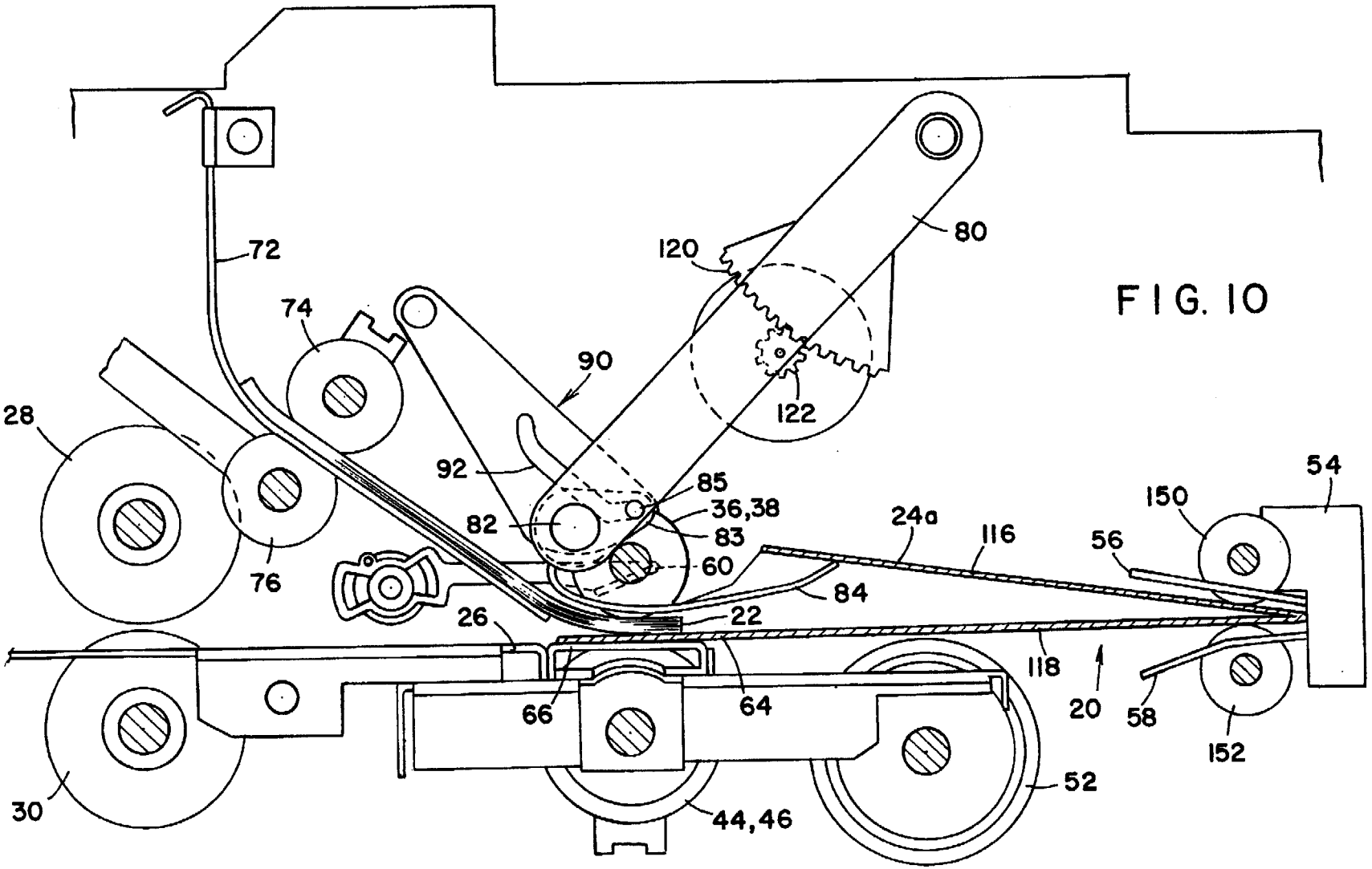
FIG. 10 is similar to FIG. 7 but shows the opening horns at the end of their cycle and the envelope fully opened with enclosure documents starting to be inserted into the fully opened envelope.

Additional separation of the envelope panels 116 and 118 is effected by the opening horns 64 and 86. Once the envelope panels 116 and 118 attain the position seen in FIG. 7, the pivotable supports 80 are rotated about 38 degrees counter-clockwise by a rack 120 and pinion gear 122 from the position seen in FIG. 7 to the position seen in FIG. 10. At this point, the bending roll 52 is pivoted downward so that the front panel 118 and the flap 64 are lying in substantially the same horizontal plane. The counter-clockwise rotation of the supports 80 causes the shaft 82 to move the link members 83 counter-clockwise which drives the pins 85 down the grooves 88 in the straight slot sections 92 and then up into the angled slot sections 94. The result of the pins 85 traversing the full length of the grooves 88 is that the shaft 82 follows the pins 85 without rotating on its own axis while the pins 85 are in the straight slot sections 92, but when the pins 85 enter the angled slot sections 94 the shaft 82 is caused to rotate about its own axis counter-clockwise. Since the opening horns 84 and 86 are fixedly secured to the shaft 82, the horns 84 and 86 are caused to rotate counter-clockwise about the axis of the shaft 82, as seen in FIG. 9. The result of the rotation of the horns 84 and 86 on the back panel 116 is seen in FIG. 10, i.e. the back panel 116 is raised more upward to virtually guarantee that the enclosure documents 22 have free entry into the envelope 24a. The path of travel of the horns 84 and 86 causes the horns 84 and 86 to be dropped onto the open flap 64. The first contact point is before the smallest throat of the smallest envelope to be handled. The horns 84 and 86 then are caused to slide down the inside back surface of the envelope, i.e. the flap 64 and the front panel 118, until the horns 84 and 86 have passed beyond the deepest throat opening to be handled. The horns 84 and 86 are then caused to be raised until the envelope 24a is positively opened, as seen in FIG. 10.

Figure 11:
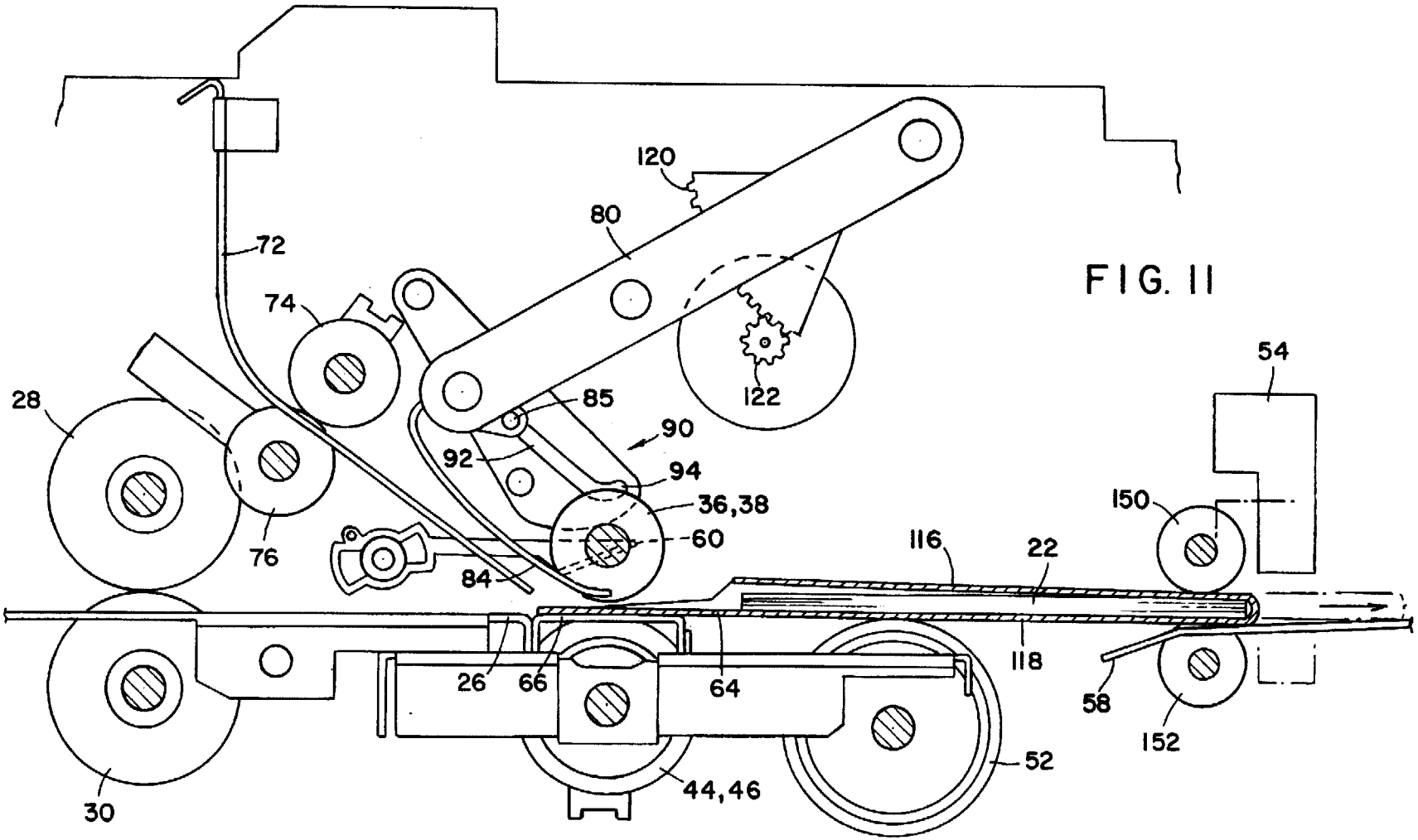
FIG. 11 is similar to FIG. 10 but shows the enclosure documents fully inserted in the envelope and the opening horns retracted from the envelope.

While the envelope 24a is being opened as described hereinabove, the enclosure documents 22 are being fed along the chute 72 toward the insert feed rollers 74 and 76 which convey the documents 22 to the feed rollers 36, 38, 40 and 42 which are now contiguous with the drive rollers 44, 46, 48 and 50 respectively, because the latter drive rollers have been translated upwardly by the translatable drive shaft 34. The feed rollers 36, 38, 40 and 42 now cooperate with the drive rollers 44, 46, 48 and 50 respectively to convey the enclosure documents 22 into the waiting envelope 24a, as seen in FIG. 11. The time for this insertion process to occur is approximately 400 to 500 miliseconds.

The horns 84 and 86 are shaped so that they will pass under the shaft 32 on the outside of the rollers 36 and 42 (see FIG. 3), but close enough to the rollers 36 and 42 to be inside the smallest envelope to be handled. If desired, a third horn could be located on the centerline between the rollers 38 and 40.

Although the foregoing description shows a pair of pivotable supports 80 and associated linkage to the shaft 82, the instant invention functions well with only a single support 80, a single link member 83, a single pin 85 and a single groove 88.

Once the envelope 24a is filled with the documents 22, as seen in FIG. 11, a pair of take-away rollers 150 and 152 engage the filled envelope 24a and the vertically translatable envelope stop 54 is caused to be raised (by means not shown) so that the filled envelope 24a can exit the insertion station 20.

It should be understood by those skilled in the art that various modifications may be made in the present invention without departing from the spirit and scope thereof, as described in the specification and defined in the appended claims.

What is claimed is:

1. Apparatus for opening an envelope having a front portion panel, a back panel and a closing flap, comprising:

means for supporting the envelope in a substantially horizontal plane wherein said back panel is situated above said front panel;

means for holding said closing flap below said front panel;

an opening horn for separating said back panel from said front panel, said opening horn being pivotable in a vertical plane above said front panel; and a bracket member having a groove operatively connected to said opening horn, said groove having a major portion defining a straight slot section at an upstream end and a minor portion defining an angled section at a downstream end of said groove, whereby said major portion causes said horn to initially contact said closing flap and to pivot said horn into said envelope between said front panel and back panels, and said minor portion causes said horn to disengage with said closing flap and raise said horn inside said envelope, whereby said front panel and back panels are separated.

2. The apparatus of claim 1, wherein said horn contacting, pivoting and raising means comprises a pivotable support arm, a shaft rotatably secured to said support arm, a link member fixedly secured to said shaft, a pin rotatably secured to said link member, and a groove for engaging said pin, and wherein said horn is fixedly secured to said shaft.

3. The apparatus of claim 1, wherein the angled slot section and straight slot section each includes an axis, and wherein the axis of the angled slot section is oriented at an angle of between about 50 to 70 degrees with the axis of the straight slot section.

4. The apparatus of claim 3, wherein said envelope supporting means comprises a pair of pivotable paddles situated beneath said closing flap.

5. The apparatus of claim 4, wherein said flap holding means comprises a pair of hold-down fingers located above said pair of pivotable paddles.

* * * * *